US012501988B2

(12) United States Patent
Kim

(10) Patent No.: US 12,501,988 B2
(45) Date of Patent: Dec. 23, 2025

(54) SUBSTANCE CONTAINER

(71) Applicant: YONWOO CO., LTD., Incheon (KR)

(72) Inventor: Soo Hwan Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 18/833,249

(22) PCT Filed: Mar. 6, 2023

(86) PCT No.: PCT/KR2023/003018

§ 371 (c)(1),
(2) Date: Jul. 25, 2024

(87) PCT Pub. No.: WO2023/172001

PCT Pub. Date: Sep. 14, 2023

(65) Prior Publication Data

US 2025/0098838 A1 Mar. 27, 2025

(30) Foreign Application Priority Data

Mar. 8, 2022 (KR) ..... 10-2022-0029267

(51) Int. Cl.
*A45D 40/22* (2006.01)

(52) U.S. Cl.
CPC ..... *A45D 40/221* (2013.01); *A45D 40/222* (2013.01); *A45D 2040/223* (2013.01); *A45D 2200/053* (2013.01)

(58) Field of Classification Search
CPC ..... B65D 77/0486; B65D 41/045; B65D 41/0478; B65D 41/0492; B65D 41/18; B65D 41/62; B65D 2251/0015; B65D 2251/0078; B65D 2251/21; B65D 1/10; B65D 23/0885; B65D 43/16; A45D 34/046; A45D 40/00; A45D 40/0068;
(Continued)

(56) References Cited

U.S. PATENT DOCUMENTS 4,948,002 A * 8/1990 Thornock ..... B65D 50/046 215/221
5,462,182 A * 10/1995 Opresco ..... B65D 50/046 215/217

(Continued)

FOREIGN PATENT DOCUMENTS

EP 3939472 A1 * 1/2022 ..... A45D 33/22
FR 3101066 A1 * 3/2021 ..... B65D 77/0493

(Continued)

*Primary Examiner* — Orlando E Aviles
*Assistant Examiner* — Brijesh V. Patel
(74) *Attorney, Agent, or Firm* — Bridgeway IP Law Group, PLLC; Sang Ho Lee; Hyun Woo Shin

(57) ABSTRACT

A container includes: a first container part for storing a given content therein; a second container part having couplers disposed on a top thereof in such a way as to surroundingly fix the outer peripheral surface of the first container part thereto; and a locking part rotatably coupled to the couplers in such a way as to surround the outer peripheral surfaces of the couplers, wherein each coupler has a pressurizer bent inward therefrom, if the locking part rotates in a first direction with respect to the couplers, to allow the outer peripheral surface of the first container part to be pressurizedly fixed thereto.

14 Claims, 6 Drawing Sheets

(58) Field of Classification Search
CPC ..... A45D 40/267; A45D 40/221–222; A45D 2200/0053; A45D 2200/1053; A45D 2040/223; A45D 33/006; A46B 9/021; A46B 15/0095
USPC ..... 220/23.91, 694, 380, 495.03, 406, 220/918–919, 23.87, 23.89; 206/581, 206/235, 823
See application file for complete search history.

(56) References Cited

U.S. PATENT DOCUMENTS

| | | | | | |
|---|---|---|---|---|---|
| 5,704,378 | A * | 1/1998 | Machelett | A45C 13/005 | 206/823 |
| 5,975,093 | A * | 11/1999 | Joulia | A45D 40/22 | 220/291 |
| 6,070,749 | A * | 6/2000 | Joulia | A45D 40/221 | 220/817 |
| 6,772,899 | B2 * | 8/2004 | Delmon | A45D 40/221 | 220/812 |
| 7,314,051 | B2 * | 1/2008 | Yuhara | A45D 33/006 | 132/294 |
| 7,503,331 | B2 * | 3/2009 | Eng | A45D 33/025 | 132/294 |
| 9,375,071 | B1 * | 6/2016 | Wang | A45D 33/22 | |
| 9,422,091 | B2 * | 8/2016 | Martin | B65D 50/043 | |
| 9,452,873 | B2 * | 9/2016 | Eberlein | B65D 55/16 | |
| 9,867,447 | B1 * | 1/2018 | Kim | A45D 40/24 | |
| 10,322,854 | B1 * | 6/2019 | Wang | B65D 43/164 | |
| 2003/0192892 | A1 * | 10/2003 | Fujita | B65D 50/061 | 220/291 |
| 2003/0217761 | A1 | 11/2003 | Maelstaf | | |
| 2017/0303662 | A1 * | 10/2017 | Jeong | B29C 43/52 | |
| 2019/0075908 | A1 * | 3/2019 | Schlatter | A45D 40/06 | |
| 2021/0120937 | A1 * | 4/2021 | Lee | A45D 40/221 | |
| 2022/0211161 | A1 * | 7/2022 | Del Din | A45D 34/00 | |
| 2022/0312935 | A1 * | 10/2022 | Del Din | A45D 40/0068 | |
| 2023/0356890 | A1 * | 11/2023 | Chen | A61J 1/14 | |

FOREIGN PATENT DOCUMENTS

| | | | | | |
|---|---|---|---|---|---|
| JP | 3805811 | B2 * | 8/2006 | | |
| JP | 3805812 | B2 * | 8/2006 | | |
| JP | 4375503 | B2 * | 12/2009 | | |
| JP | 2019-081595 | A | 5/2019 | | |
| KR | 20-0310109 | Y1 | 4/2003 | | |
| KR | 20160013734 | A * | 2/2016 | A45D 33/24 | |
| KR | 101660112 | B1 * | 9/2016 | A45D 33/006 | |
| KR | 20-2016-0003369 | U | 10/2016 | | |
| KR | 200487151 | Y1 * | 8/2018 | B65D 47/20 | |
| KR | 102045527 | B1 * | 11/2019 | A45D 40/22 | |
| KR | 10-2021-0050865 | A | 5/2021 | | |
| KR | 10-2021-0157223 | A | 12/2021 | | |
| WO | WO-2017103165 | A1 * | 6/2017 | A45D 40/22 | |

* cited by examiner

SUBSTANCE CONTAINER

TECHNICAL FIELD

The present invention relates to a substance container.

BACKGROUND ART

Among cosmetics, color cosmetics such as eyeshadows, shades, blushers, foundations, and the like are provided in the form of a compact container having an inner container for storing a cosmetic content and an outer container for fixing the inner container thereto. As the inner container and the outer container of the compact container are formed integrally with each other, it is impossible to separate them from each other, and otherwise, they are tightly coupled to each other by means of an adhesive or the like, it is hard to separate the inner container from the outer container. As a result, after the cosmetic content is used up, it is difficult that only the inner container is replaced with new one to allow the outer container to be reusable.

In the case where the inner container and the outer container of the compact container are made of different materials from each other, further, they are necessary to be separated from each other in a process where the compact container is thrown away. In the case of the conventional compact container, however, it is impossible to separate the inner container from the outer container, or even if possible, the remaining cosmetic material in the separation process may be applied dirtily to a hand. Further, nails may be damaged due to the separation process. As a result, such a separation process may cause many inconveniences.

Generally, the compact container is configured to have a container part in which a given content is stored and a covering part for opening and closing the container part. The covering part is rotatably coupled to one side of the container part, and a hinge pin made of a metal material is used to rotate the covering part. In this case, it is hard to separate only the hinge pin from the compact container made of a synthetic resin, thereby making it difficult to recycle the compact container.

DISCLOSURE OF THE INVENTION

Technical Problems

Accordingly, to solve the above-mentioned problems occurring in the related art, it is an object of the present invention to provide a container that is capable of allowing a first container part in which a given content is stored to be fixed or easily separated from a second container part by means of simple rotations of a locking part.

The technical problems to be achieved through the present invention are not limited as mentioned above, and other technical problems not mentioned herein will be obviously understood by one of ordinary skill in the art through the following description.

Technical Solutions

To accomplish the above-mentioned objects, according to the present invention, there is provided a container. The container may include: a first container part for storing a given content therein; a second container part having couplers disposed on a top thereof in such a way as to surroundingly fix the outer peripheral surface of the first container part thereto; and a locking part rotatably coupled to the couplers in such a way as to surround the outer peripheral surfaces of the couplers, wherein each coupler has a pressurizer bent inward therefrom, if the locking part rotates in a first direction with respect to the couplers, to allow the outer peripheral surface of the first container part to be pressurizedly fixed thereto.

Advantageous Effects of the Invention

According to the present invention, the container is configured to allow the first container part in which the given content is stored to be fixed or easily separated from the second container part by means of the simple rotations of the locking part, so that only the first container part is replaced with new one, thereby allowing the container to be recyclable.

According to the present invention, further, the container is configured to allow the first container part to be easily separated and discharged from the second container part if the first container part and the second container part are made of different materials, thereby improving the conveniences of use.

According to the present invention, furthermore, the container is configured to allow the second container part and the covering part to be detachably fitted to each other, so that they are easily coupled to each other, without any hinge pin, thereby allowing the container to be recyclable.

According to the present invention, additionally, the container is configured to have at least a portion made of a transparent or semi-transparent material, so that the type, color, and remaining amount of the content stored therein to be easily checked by the user.

BRIEF DESCRIPTION OF DRAWINGS

To allow the drawings as will be mentioned in the description of the present invention to be more sufficiently understood, the brief description of the drawings may be provided.

BEST MODE FOR INVENTION

Figure 1:
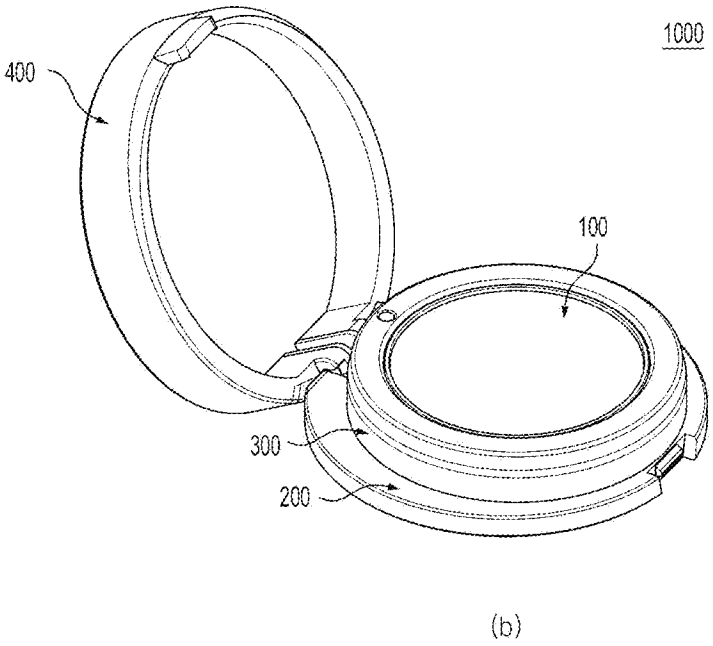
FIG. 1 is a perspective view showing a container according to an embodiment of the present invention.
Figure 1:
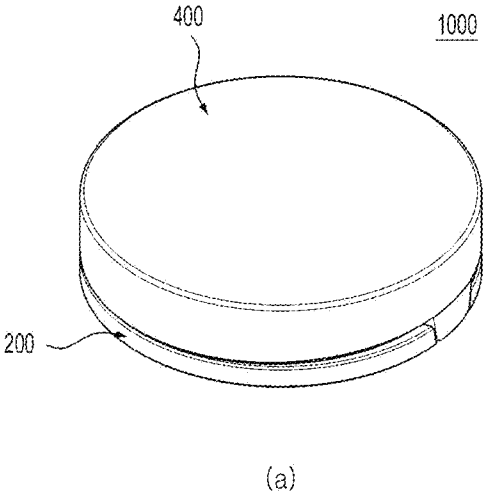

According to an embodiment of the present invention is provided a container. The container includes: a first container part for storing a given content therein; a second container part having couplers disposed on a top thereof in such a way as to surroundingly fix the outer peripheral surface of the first container part thereto; and a locking part rotatably coupled to the couplers in such a way as to surround the outer peripheral surfaces of the couplers, wherein each coupler has a pressurizer bent inward therefrom, if the locking part rotates in a first direction with respect to the couplers, to allow the outer peripheral surface of the first container part to be pressurizedly fixed thereto.

Further, if the locking part rotates in a second direction opposite to the first direction with respect to the couplers, the pressurizers return to original positions thereof to allow the pressurization against the first container part to be released, so that the first container part is separated from the couplers.

Furthermore, the locking part has guide portions protruding from the inner peripheral surface thereof and having slant surfaces formed in a horizontal direction on given regions thereof, and if the locking part rotates in the first direction, the pressurizers come into close contact with the slant surfaces and move relative to the locking part, so that the pressurizers are bent inward from the couplers.

Besides, the pressurizers extend by a given length in the second direction from tops of the couplers.

Moreover, the couplers include a first coupler and a second coupler spaced apart from each other to surround different regions of the outer peripheral surface of the first container part, and the pressurizers extend in the second direction from top of one side of the first coupler and from top of one side of the second coupler.

Further, if the guide portions of the locking part are inserted into spaces between the first coupler and the second coupler, the slant surfaces are aligned with positions corresponding to the pressurizers.

Furthermore, the locking part has at least one or more guide protrusions protruding from the inner peripheral surface thereof, and the couplers have at least one or more guide grooves concavely formed on the outer peripheral surfaces thereof in such a way as to correspond to the guide protrusions, so that if the locking part rotates, the guide protrusions move along the guide grooves to allow the locking part to rotate at a constant height.

Additionally, each guide groove extends from one point of the outer peripheral surface of the corresponding coupler to one point of the corresponding pressurizer in a circumferential direction.

Further, each coupler has a first locking projection formed on the bottom thereof, and each guide portion has a second locking projection protruding from the bottom of the slant surface thereof, so that if the locking part rotates in the first direction, the second locking projections of the locking part move under the pressurizers and come into contact with the end portions of the first locking projections to allow the locking part to be prevented from additionally rotating in the first direction.

Moreover, the locking part has locking protrusions formed on the inner peripheral surface of in such a way as to be spaced apart from the guide portions by a given distance, and the couplers have locking grooves formed on the outer peripheral surfaces of the first locking projections in such a way as to correspond to the locking protrusions, so that the locking protrusions are inserted into the locking grooves to allow the locking part to be prevented from arbitrarily rotating.

The container according to the present invention further includes a covering part detachably coupled to one side of the second container part in such a way as to rotate with respect to the second container part to open and close the second container part.

Further, the second container part has a first hinge recessed inward from one side thereof, and the covering part has a second hinge protruding from one side thereof in such a way as to be inserted into the first hinge, so that if the second hinge is inserted into the first hinge, the covering part is detachably coupled to the second container part.

Furthermore, the first hinge includes: an incised portion recessed inward from the second container part; and at least one or more hinge protrusions protruding inward from the incised portion, and the second hinge includes: a protruding portion protruding downward from the covering part; and at least one or more hinge grooves recessed inward from the protruding portion in such a way as to correspond to the hinge protrusions, whereby if the second hinge is inserted into the first hinge, the hinge protrusions are fittedly coupled to the hinge grooves to allow the covering part to be rotatable with respect to the second container part around the hinge protrusions.

Besides, the covering part has at least a portion made of a transparent or semi-transparent material so that the given content stored in the first container part is seen outside the container.

Mode for Invention

Hereinafter, exemplary embodiments of the present invention will be described in detail with reference to the accompanying drawings. Further, a method for configuring and using a device according to the embodiment of the present invention will be explained in detail with reference to the attached drawings and specification. In the drawings, reference numerals or symbols, with respect to the same elements, even though they may be displayed in different drawings, such elements use same reference numerals as much as possible. Further, top, bottom, left and right directions as will be described below are determined with reference to the drawings, and accordingly, the scope of the present invention is not necessarily restricted to the corresponding directions.

It shall be understood that, although the terms "first," "second," etc. may be used herein to describe various information, the information should not be limited by these terms. These terms are only used to distinguish one category of information from another. For example, a first element may be named a second element without departing from the scope of the present invention. Likewise, a second element may be named a first element.

Terms used in this application are used to only describe specific exemplary embodiments and are not intended to restrict the present invention. An expression referencing a singular value additionally refers to a corresponding expression of the plural number, unless explicitly limited otherwise by the context. In this application, terms, such as "comprise", "include", or "have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

In the entire specification, when it is said that one element is described as being "connected" or "coupled" to the other element, one element may be directly connected or coupled to the other element, but it should be understood that another element may be present between the two elements. Further, when it is said that one portion is described as "includes" any component, one element further may include other components unless no specific description is suggested.

Figure 2:
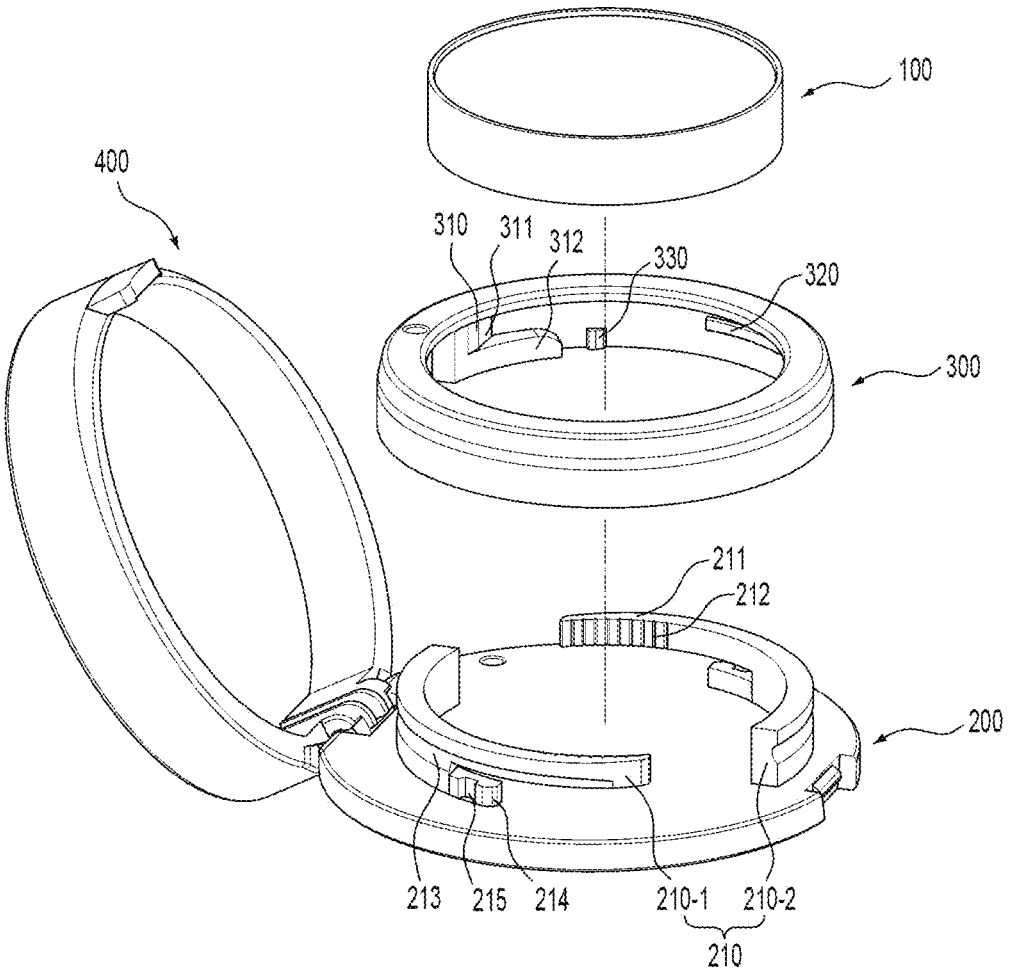
FIG. 2 is an exploded perspective view showing the container according to the embodiment of the present invention.
Figure 3:
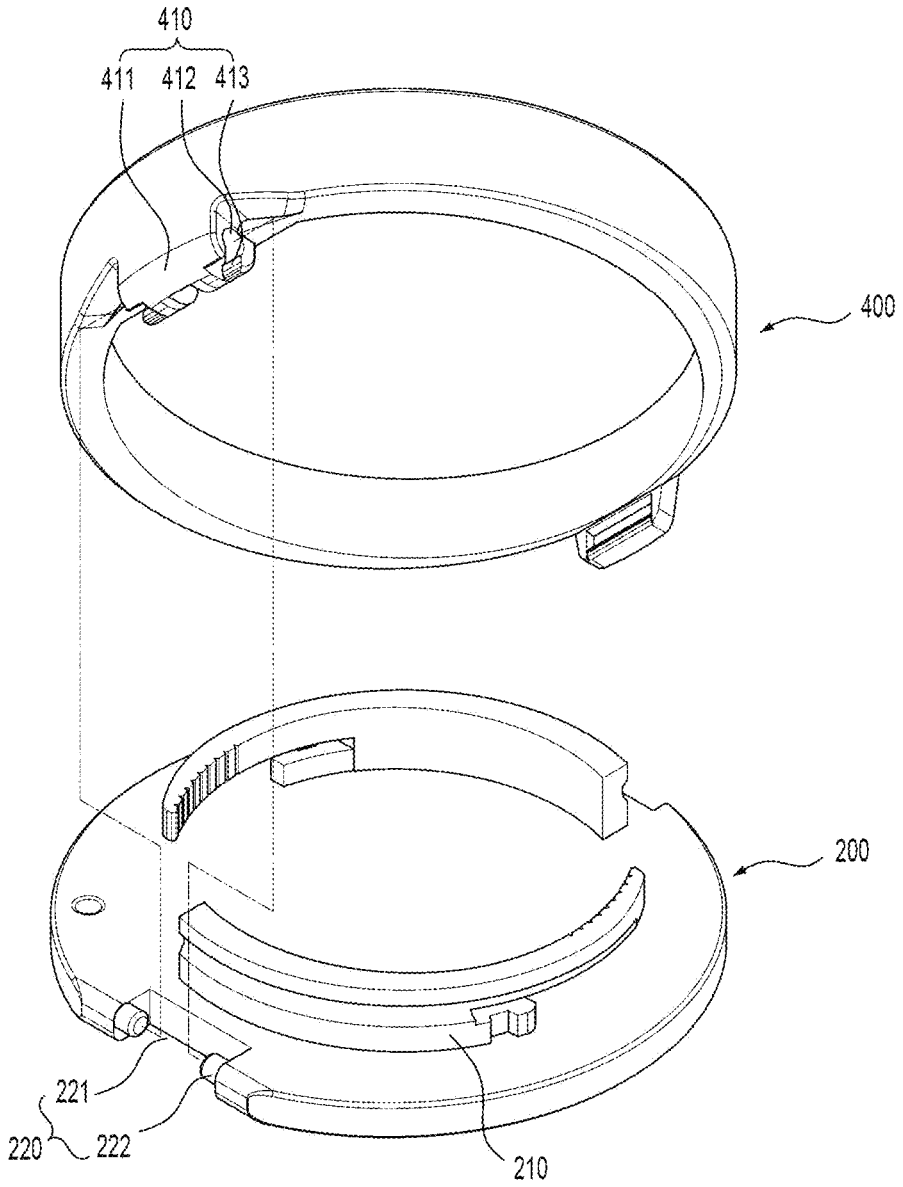
FIG. 3 is an exploded perspective view showing a second container part and a covering part of the container according to the embodiment of the present invention.

FIG. 1 is a perspective view showing a container according to an embodiment of the present invention, FIG. 2 is an exploded perspective view showing the container according to the embodiment of the present invention, and FIG. 3 is an exploded perspective view showing a second container part and a cover part of the container according to the embodiment of the present invention. In detail, FIG. 1*a* shows a state where a container is closed, and FIG. 1*b* shows a state where the container is open.

Referring to FIGS. 1 to 3, a container 1000 according to an embodiment of the present invention includes a first container part 100, a second container part 200, a locking part 300, and/or a covering part 400.

The first container part 100 stores a given content therein. In this case, the given content is a solid, semi-solid, powder, liquid or gel cosmetic content. For example, the content may be a base, blusher, shade, eyeshadow, eyebrow, lotion, milk lotion, moisture lotion, nutrition lotion, skin lotion, skin softer, skin toner, astringent, massage cream, nutrition cream, whitening essence, tone-up cream, sunblock, sun cream, sun milk, BB cream, foundation, CC cream, concealer, eye cream, primer, and the like. However, the content may not be limited thereto, and therefore, the content may include different formulations or types of cosmetics or medicines.

For example, the first container part 100 has a circular, oval, or polygonal base surface and a peripheral surface extending upward from the base surface and is open on top thereof to form a storage space portion in which the content is stored. In detail, the first container part 100 has various shapes, such as a cylinder, a cone, a truncated cone, a semi-sphere, a polygonal column, a polygonal cone, and a polygonal truncated cone whose tops are open. In this case, the polygonal column, the polygonal cone, and the polygonal truncated cone have flat surfaces or curved surfaces with given curvatures.

Further, the first container part 100 has at least a portion made of a metal material such as aluminum, copper, titanium, magnesium, iron, and the like. However, of course, the first container part 100 may be made of a synthetic resin such as polypropylene (PP), polyethylene terephthalate (PET), polyethylene terephthalate glycol-modified (PETG), and the like or a natural material such as a fabric, paper, fibers, Tencel, silk, and the like.

The second container part 200 has a coupler 210 located on a top thereof to fix the first container part 100 thereto. The coupler 210 serves to surround the outer periphery of the first container part 100 and thus fix the first container part 100 thereto.

According to the embodiment of the present invention, the coupler 210 includes a pressurizer 211, vertical grooves 212, a guide groove 213, a first locking projection 214 and/or a locking groove 215.

The pressurizer 211 serves to fix the first container part 100 to the second container part 200 or separate the first container part 100 from the second container part 200 according to rotations of the locking part 300.

For example, if the locking part 300 rotates in a first direction (e.g., in a clockwise direction) with respect to the coupler 210, the pressurizer 211 is bent inward from the coupler 210 and pressurizes the outer peripheral surface of the first container part 100, so that the first container part 100 is fixed to the second container part 200. In FIG. 2, the first direction represents the clockwise direction, but without being limited thereto, the first direction may represent a counterclockwise direction.

Further, for example, if the locking part 300 rotates in a second direction (e.g., in the counterclockwise direction) opposite to the first direction with respect to the coupler 210 in the state where the pressurizer 211 pressurizes the first container part 100, the pressurizer 211, which has been bent inward from the coupler 210, returns to its original position. Accordingly, the pressurization of the pressurizer 211 against the first container part 100 is released, so that the first container part 100 is separated from the coupler 210. If the content stored in the first container part 100 is all consumed, the first container part 100 is easily separated from the coupler 210 by means of the rotation of the locking part 300, so that the first container part 100 is replaced with a new first container part 100. Further, if the first container part 100 and the second container part 200 have different materials (for example, if the first container part 100 is made of an aluminum material and the second container part 200 is made of a plastic material), the first container part 100 is easily separated and discharged from the second container part 200.

According to the embodiment of the present invention, the pressurizer 211 has at least a portion made of an elastic material so that it is bent inward from the coupler 210 or returns to its original position according to the rotational directions of the locking part 300. However, the pressurizer 121 may not be limited thereto.

According to the embodiment of the present invention, the pressurizer 211 extends by a given length in the second direction on top of the coupler 210 (in detail, on top of one side surface of the coupler 210). When the locking part 300 rotates in the first direction, the pressurizer 211 extending by the given length allows a relatively large area thereof to come into contact with the locking part 300 (especially, a slant surface 311), receives a pressurizing force from the contact, and is thus easily bent inward from the coupler 210.

The plurality of vertical grooves 212 are formed so that when the locking part 300 rotates, they serve to facilitate elastic deformation of the pressurizer 211. For example, the vertical grooves 212 are spaced apart from one another along the inner surface of the pressurizer 211. The elastic deformation of the pressurizer 211 is more easily made by means of the vertical grooves 212, so that the pressurizer 211 comes into contact with the outer peripheral surface of the first container part 100 more tightly to pressurizingly fix the first container part 100 thereto.

Even if the size of the first container part 100 is changed within a given range, further, the pressurizer 211 is elastically deformed correspondingly to the size of the first container part 100 by means of the vertical grooves 212. Irrespective of the size of the first container part 100, that is, the pressurizer 211 can come into close contact with the outer peripheral surface of the first container part 100 to pressurizingly fix the first container part 100 thereto.

The guide groove 213 is concavely formed along the outer peripheral surface of the coupler 210. The guide groove 213 serves to insert a guide protrusion 320 of the locking part 300 so that when the locking part 300 rotates with respect to the second container part 200, the guide protrusion 320 moves along the guide groove 213. That is, when the locking part 300 rotates, the rotational height of the locking part 300 is constantly kept by means of the guide groove 213 and the guide protrusion 320.

According to the embodiment of the present invention, the guide groove 213 extends from one point of the outer peripheral surface of the coupler 210 to one point of the pressurizer 211 in a circumferential direction. As the guide groove 213 extends up to the outer peripheral surface of the pressurizer 211, the locking part 300 rotates in the first or second direction more stably by means of the user, thereby allowing the first container part 100 to be coupled to or separated from the second container part 200.

The first locking projection 214 is formed on the bottom of the coupler 210 and comes into contact with a second locking projection 312 of the locking part 300 rotating in the first direction to prevent the locking part 300 from additionally rotating in the first direction. For example, the pressurizer 211 extends in the second direction from top of one side surface of the coupler 210, and the first locking projection 214 protrudes by a given length from the bottom (that is, under the pressurizer 211) of one side surface of the coupler 210 where the pressurizer 211 is formed in the second direction.

The locking groove 215 is formed on the outer peripheral surface of the coupler 210, and as a locking protrusion 330 of the locking part 300 is inserted into the locking groove 215, the locking part 300 is prevented from arbitrarily rotating. For example, the locking groove 215 is formed on the outer peripheral surface of the first locking projection 214, thereby preventing the locking part 300 from additionally rotating in the first direction by means of the first locking projection 214, while preventing the locking part 300 from rotating in the first direction and arbitrarily rotating in the second direction by means of the locking groove 215.

According to the embodiment of the present invention, a plurality of couplers 210 are provided to surround different regions of the outer peripheral surface of the first container part 100. For example, a first coupler 210-1 and a second coupler 210-2 are provided as the couplers 210. The first coupler 210-1 and the second coupler 210-2 are spaced apart from each other to surround different regions of the first container part 100. In this case, the pressurizers 211 extend in the second direction from top of one side of the first coupler 210-1 and from top of one side of the second coupler 210-2, and they pressurize the different regions of the outer peripheral surface of the first container part 100, thereby fixing the first container part 100 thereto. Like this, as the plurality of regions (especially, the outer peripheral surfaces in opposite directions to each other) of the first container part 100 are pressurized and fixed, the first container part 100 is fixed to the couplers 210 more tightly. In FIGS. 2 and 3, two couplers 210 are provided, but without being limited thereto, three or more couplers 210 may be provided.

The second container part 200 has a first hinge 220 recessed on one side thereof. The first hinge 220 serves to insert the covering part 400 (especially a second hinge 410), thereby allowing the second container part 200 to be detachably coupled to the covering part 400.

According to the embodiment of the present invention, the first hinge 220 includes an incised portion 221 and at least one or more hinge protrusions 222. The incised portion 221 is recessed inward from the second container part 200 and inserts a protruding portion 411 of the covering part 400 thereinto. Further, the hinge protrusions 222 protrude inward from the incised portion 221 and are inserted into hinge grooves 412 of the covering part 400. For example, the hinge protrusions 222 protrude inward from the facing inner surfaces of the incised portion 221.

According to the embodiment of the present invention, the second container part 200 is made of a recyclable material. The second container part 200 is made of a reusable material having no post processing, and therefore, the second container part 200 is eco-friendly. For example, the second container part 200 is made of polypropylene (PP), polyethylene terephthalate (PET), or polyethylene terephthalate glycol-modified (PETG). However, the second container part 200 may be made of other materials, without being limited thereto.

The locking part 300 rotates with respect to the couplers 210 to allow the first container part 100 to be fixed to or separated from the couplers 210. To do this, the locking part 300 is rotatably coupled to the couplers 210 in such a way as to surround the outer peripheral surfaces of the couplers 210.

According to the embodiment of the present invention, the locking part 300 includes guide portions 310, the guide protrusions 320, and the locking protrusions 330.

The guide portions 310 protrude from the inner peripheral surface of the locking part 300 and allow the pressurizers 211 to be bent inward from the couplers 210 according to the rotation of the locking part 300.

To do this, each guide portion 310 has the slant surface 311 formed in a horizontal direction on a given region thereof. For example, the slant surface 311 increases in a protruding height from the guide portion 310 in the second direction. If the locking part 300 rotates in the first direction, accordingly, the pressurizers 211 come into close contact with the slant surfaces 311 and move relative to the locking part 300, so that they are bent inward from the couplers 210.

According to the embodiment of the present invention, if the first coupler 210-1 and the second coupler 210-2 are provided as the couplers 210, the guide portions 310 of the locking part 300 are alignedly inserted into spaces between the first coupler 210-1 and the second coupler 210-2. To couple the locking part 300 to the couplers 210, that is, the guide portions 310 of the locking part 300 are first aligned to be located above the spaces between the first coupler 210-1 and the second coupler 210-2, and next, the locking part 300 moves down to allow the guide portions 310 to be inserted into the corresponding spaces. Accordingly, the slant surfaces 311 are aligned with positions and heights corresponding to the pressurizers 211, and the guide protrusions 320 are aligned with positions corresponding to the guide grooves 213, so that if the locking part 300 rotates, the second container part 200 and the locking part 300 are coupled to each other.

According to the embodiment of the present invention, each guide portion 310 has the second locking projection 312 protruding from the underside of the slant surface 311. The second locking projection 312 comes into contact with the end portion of the first locking projection 214 of each coupler 210, thereby limiting the movement of the locking part 300 rotating in the first direction. In detail, if the locking part 300 rotates in the first direction, the second locking projection 312 moves under the corresponding pressurizer 211 and comes into contact with the end portion of the first locking projection 214, thereby preventing the locking part 300 from additionally rotating in the first direction. To do this, for example, the pressurizer 211 extends in the second direction from top of one side surface of the coupler 210, the first locking projection 214 protrudes from the bottom of the coupler 210, and the second locking projection 312 extends in the first direction.

The guide protrusion 320 protrudes from the inner peripheral surface of the locking part 300 so that it is inserted into the guide groove 213 of the coupler 210, if the locking part 300 rotates, and moves along the guide groove 213. For example, the guide protrusion 320 extends by a given length in a horizontal direction (or in the rotating direction of the locking part 300). While the locking part 300 is rotating in the first direction, the pressurizer 211 is bent inward from the coupler 210 and thus generates an external force (that is, an elastic restoring force of the pressurizer 211), and even under such an external force, the locking part 300 rotates to a given height, without escaping from the coupler 210.

The locking protrusion 330 is inserted into the locking groove 215 of the coupler 210, thereby preventing the locking part 300 from arbitrarily rotating. If an external force greater than a given size in the second direction is applied to the locking part 300 in the state where the locking protrusion 330 is inserted into the locking groove 215, the locking protrusion 330 escapes from the locking groove 215, thereby allowing the locking part 300 to rotate in the second direction. For example, the locking protrusion 330 is formed on the inner peripheral surface of the locking part 300 in such a way as to be spaced apart from the guide portion 310 by a given distance, and the locking groove 215 is formed on the outer peripheral surface of the first locking projection 214 in such a way as to correspond to the locking protrusion 330. In this case, if the locking part 300 rotates in the first direction to allow the second locking projection 312 to come into contact with the end portion of the first locking projection 214, the locking protrusion 330 can be inserted into the locking groove 215.

The covering part 400 is detachably coupled to one side of the second container part 200 in such a way as to rotate with respect to the second container part 200 to open and close the second container part 200. To do this, the covering part 400 has the second hinge 410 protruding therefrom in such a way as to correspond to the first hinge 220 of the second container part 200. That is, as the second hinge 410 is inserted into the first hinge 220, the covering part 400 is detachably coupled to the second container part 200. Accordingly, the covering part 400 is simply fitted to the second container part 200, without having any existing hinge pin used to rotatably couple the container and the cover to each other.

According to the embodiment of the present invention, the second hinge 410 includes the protruding portion 411 protruding downward therefrom and at least one or more hinge grooves 412 recessed inward from the protruding portion 411. For example, if the plurality of hinge protrusions 222 protrude inward from the facing inner surfaces of the incised portion 221, the plurality of hinge grooves 412 are recessed inward from both sides of the protruding portion 411 in such a way as to correspond to the hinge protrusions 211. As the second hinge 410 is inserted into the first hinge 220, the hinge protrusions 222 are fittedly coupled to the hinge grooves 412, so that the covering part 400 is rotatable with respect to the second container part 200 around the hinge protrusions 222.

According to the embodiment of the present invention, an open portion 413 is formed on an open region of the hinge groove 412. The open portion 413 extends downward from at least a portion of the open region of the hinge groove 412 and thus forms a path for inserting the hinge protrusion 222 when the second hinge 410 is coupled to the first hinge 220. That is, if the second container part 200 and the covering part 400 are coupled to each other to allow the second hinge 410 to be inserted into the first hinge 220, the hinge protrusions 222 are easily inserted into the hinge grooves 412 by means of the open portions 413. Further, for example, the open portions 413 increase in width toward the lower sides thereof. As a result, the hinge protrusions 222 are more easily inserted into the hinge grooves 412, and after the insertion, they are prevented from escaping from the hinge grooves 412.

According to the embodiment of the present invention, the covering part 400 has at least a portion made of a transparent or semi-transparent material. As a result, the content stored in the first container part 100 is seen outside of the container 1000, thereby allowing the type, color, and remaining amount of the content to be checked by the user. For example, at least a portion of the covering part 400 is made of polypropylene (PP), polyethylene terephthalate (PET), or polyethylene terephthalate glycol-modified (PETG), which is the same material as the second container part 200. However, the covering part 400 may be made of a different material from the second container part 200, without being limited thereto.

The container 1000 as shown in FIGS. 1 to 3 is just exemplary, and therefore, the container 1000 may have various configurations according to embodiments of the present invention.

Figure 4:
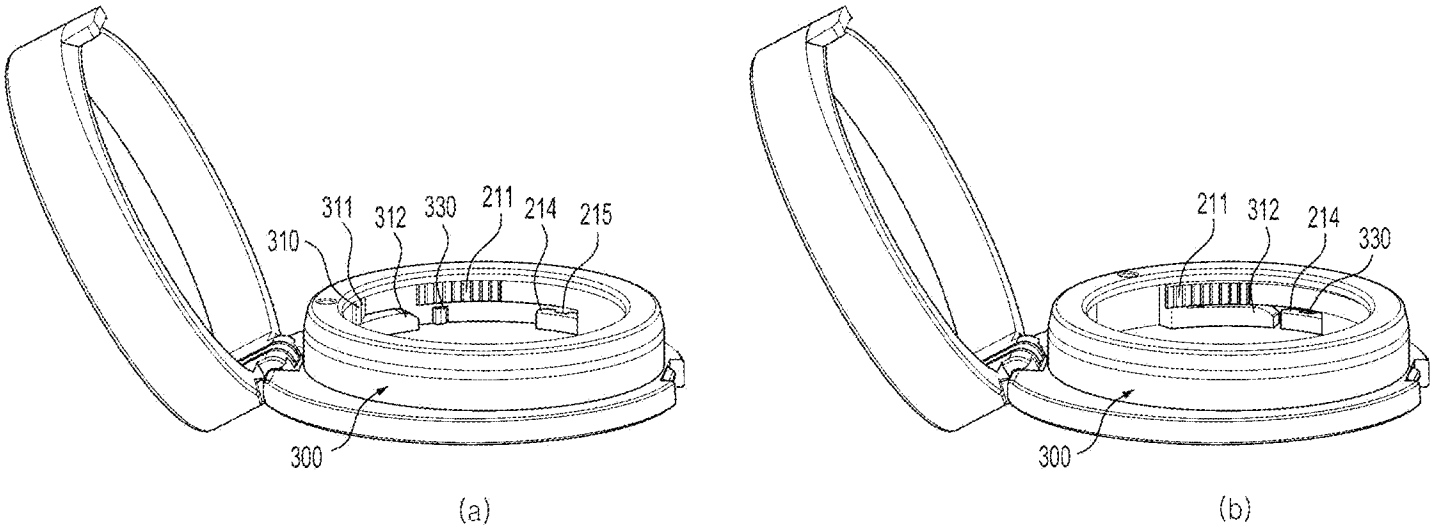
FIGS. 4 to 6 show operations of the container according to the embodiment of the present invention.
Figure 5:
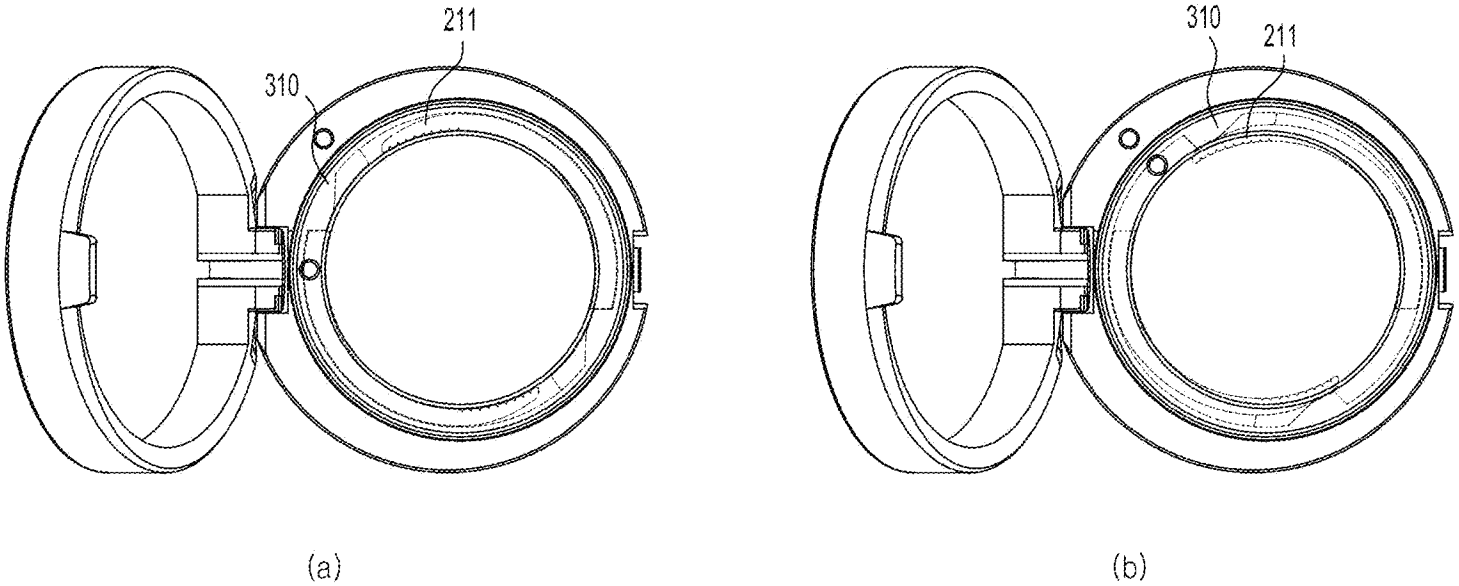
Figure 6:
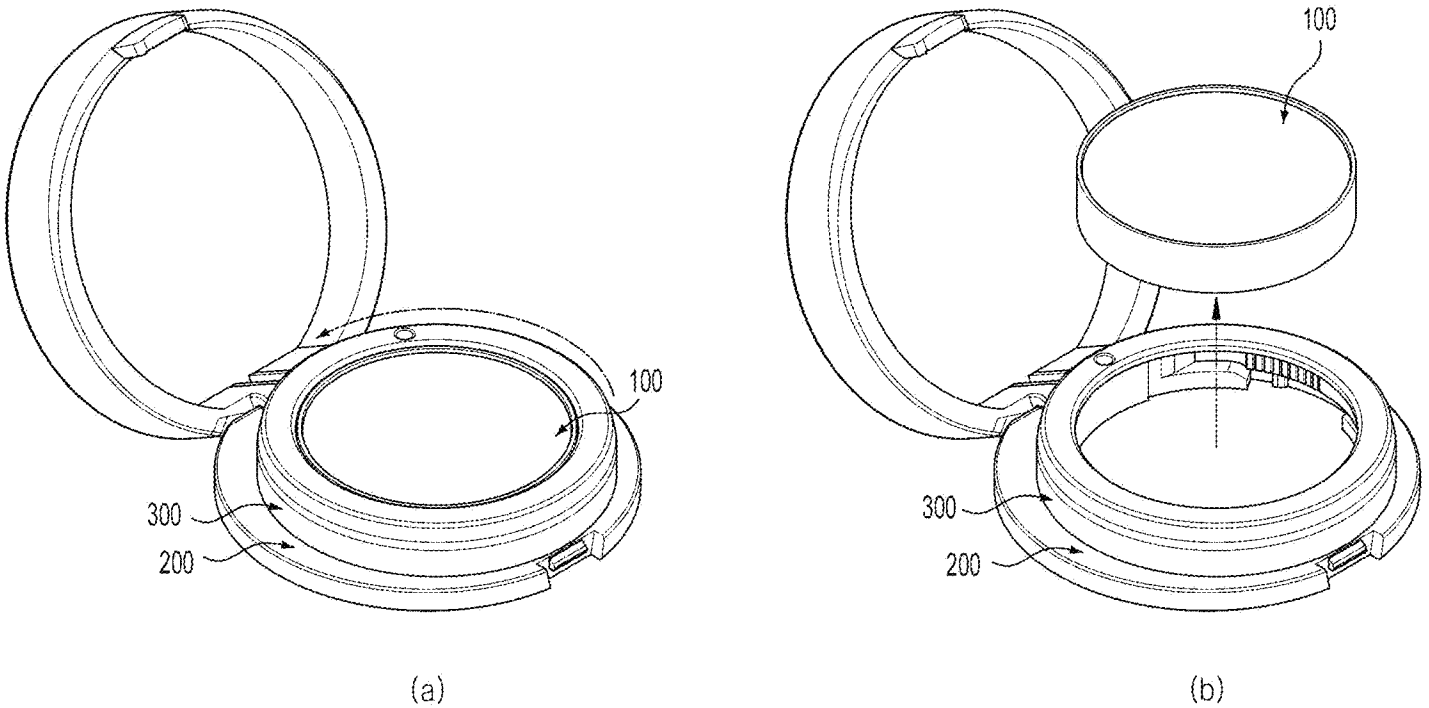

FIGS. 4 to 6 show operations of the container according to the embodiment of the present invention. In detail, FIGS. 4 and 5 are perspective and plan views showing the container 1000 where the first container part 100 is removed. FIGS. 4*a* and 5*a* show states where the pressurization of the pressurizers 211 against the first container part 100 is released, and FIGS. 4*b* and 5*b* show states where the first container part 100 is pressurizedly fixed to the pressurizers 211. Further, FIG. 6*a* shows a state where the first container part 100 is pressurized against the pressurizers 211, and FIG. 6*b* shows a state where the first container part 100 is separated from the second container part 200.

Referring first to FIGS. 4 and 5, if the locking part 300 rotates in the first direction with respect to the couplers 210, the pressurizers 211 move relative to the locking part 300 and thus come into contact with the slant surfaces 311 of the guide portions 310, so that they are bent inward from the couplers 210. As a result, the pressurizers 211 pressurize the outer peripheral surface of the first container part 100 to allow the first container part 100 to be fixed to the second container part 200.

Further, the second locking projections 312 of the locking part 300 move in the first direction under the pressurizers 211 and come into contact with the end portions of the first locking projections 214, so that the locking part 300 is prevented from additionally rotating in the first direction. In this case, the locking protrusions 330 of the locking part 300 are inserted into the locking grooves 215 of the couplers 210, so that the locking part 300 is prevented from arbitrarily rotating in the first and second directions.

Referring to FIG. 6, furthermore, if the locking part 300 rotates in the second direction in the state where the pressurizers 211 pressurize the first container part 100, the pressurizers 211, which have been bent inward from the couplers 210, return to their original position. As a result, the pressurization of the pressurizers 211 against the first container part 100 is released to allow the first container part 100 to be separated from the couplers 210.

The operations of the container 1000 as shown in FIGS. 4 to 6 are just exemplary, and therefore, the operations of the container 1000 may be freely performed according to embodiments of the present invention.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention. It should be therefore understood that the embodiments of the present invention are just exemplary embodiments, while not limiting the present invention. Persons skilled in the relevant art can appreciate that many modifications and variations are possible in light of the above teachings. It is therefore intended that the scope of the invention be limited not by this detailed description, but rather by the claims appended hereto.

The invention claimed is:

1. A container comprising:

a first container part for storing a given content therein;

a second container part having couplers disposed on a top thereof in such a way as to surroundingly fix an outer peripheral surface of the first container part thereto;

and a locking part rotatably coupled to the couplers in such a way as to surround outer peripheral surfaces of the couplers, wherein when the locking part rotates in a first direction with respect to the couplers, each coupler has a pressurizer bent inward therefrom to allow the outer peripheral surface of the first container part to be pressurizedly fixed thereto.

2. The container according to claim 1, wherein when the locking part rotates in a second direction opposite to the first direction with respect to the couplers, each pressurizer returns to their original position thereof to allow the pressurization against the first container part to be released, so that the first container part is separated from the couplers.

3. The container according to claim 2, wherein the locking part has guide portions protruding from an inner peripheral surface thereof and having slant surfaces formed in a horizontal direction on given regions thereof, and when the locking part rotates in the first direction, each pressurizer comes into close contact with the slant surfaces and move relative to the locking part, so that each pressurizer is bent inward from the couplers.

4. The container according to claim 3, wherein each pressurizer extends by a given length in the second direction from tops of the couplers.

5. The container according to claim 4, wherein the couplers comprise a first coupler and a second coupler spaced apart from each other to surround different regions of the outer peripheral surface of the first container part, and each pressurizer extends in the second direction from top of one side of the first coupler and from top of one side of the second coupler.

6. The container according to claim 5, wherein when the guide portions of the locking part are inserted into spaces between the first coupler and the second coupler, the slant surfaces are aligned with positions corresponding to each pressurizer.

7. The container according to claim 4, wherein the locking part has at least one or more guide protrusions protruding from the inner peripheral surface thereof, the couplers have at least one or more guide grooves concavely formed on the outer peripheral surfaces thereof in such a way as to correspond to the at least one or more guide protrusions, and when the locking part rotates, the at least one or more guide protrusions move along the at least one or more guide grooves to allow the locking part to rotate at a constant height.

8. The container according to claim 7, wherein each guide groove extends from one point of the outer peripheral surface of a corresponding coupler to one point of a corresponding pressurizer in a circumferential direction.

9. The container according to claim 4, wherein each coupler has a first locking projection formed on a bottom thereof, each guide portion has a second locking projection protruding from a bottom of the slant surface thereof, and when the locking part rotates in the first direction, each second locking projection of the locking part moves under each pressurizer and come into contact with end portions of the each locking projection to allow the locking part to be prevented from additionally rotating in the first direction.

10. The container according to claim 9, wherein the locking part has locking protrusions formed on the inner peripheral surface thereof in such a way as to be spaced apart from the guide portions by a given distance, and the couplers have locking grooves formed on outer peripheral surfaces of each first locking projection in such a way as to correspond to the locking protrusions, so that the locking protrusions are inserted into the locking grooves to allow the locking part to be prevented from arbitrarily rotating.

11. The container according to claim 1, further comprising a covering part detachably coupled to one side of the second container part in such a way as to rotate with respect to the second container part to open and close the second container part.

12. The container according to claim 11, wherein the second container part has a first hinge recessed inward from one side thereof, the covering part has a second hinge protruding from one side thereof in such a way as to be inserted into the first hinge, and when the second hinge is inserted into the first hinge, the covering part is detachably coupled to the second container part.

13. The container according to claim 12, wherein the first hinge comprises:

an incised portion recessed inward from the second container part; and at least one or more hinge protrusions protruding inward from the incised portion, and the second hinge comprises:

a protruding portion protruding downward from the covering part; and at least one or more hinge grooves recessed inward from the protruding portion in such a way as to correspond to the at least one or more hinge protrusions, whereby when the second hinge is inserted into the first hinge, the at least one or more hinge protrusions, are fittedly coupled to the at least one or more hinge grooves to allow the covering part to be rotatable with respect to the second container part around the at least one or more hinge protrusions.

14. The container according to claim 11, wherein the covering part has at least a portion made of a transparent or semi-transparent material so that the given content stored in the first container part is seen from outside the container.

* * * * *